US010584534B2

(12) United States Patent
Hagar et al.

(10) Patent No.: US 10,584,534 B2
(45) Date of Patent: Mar. 10, 2020

(54) DRILLING TOOL WITH NEAR-BIT ELECTRONICS

(71) Applicant: Halliburton Energy Services, Inc., Houston, TX (US)

(72) Inventors: Everett P. Hagar, Alberta (CA); Jonathan Peter Zacharko, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 62 days.

(21) Appl. No.: 15/571,309

(22) PCT Filed: Jun. 3, 2015

(86) PCT No.: PCT/US2015/034002
§ 371 (c)(1),
(2) Date: Nov. 2, 2017

(87) PCT Pub. No.: WO2016/195677
PCT Pub. Date: Dec. 8, 2016

(65) Prior Publication Data
US 2019/0153782 A1 May 23, 2019

(51) Int. Cl.

| | |
|---|---|
| ***E21B 47/01*** | (2012.01) |
| ***E21B 4/02*** | (2006.01) |
| ***E21B 7/06*** | (2006.01) |
| ***E21B 10/32*** | (2006.01) |

(52) U.S. Cl.
CPC ..... *E21B 4/02* (2013.01); *E21B 7/064* (2013.01); *E21B 10/32* (2013.01); *E21B 47/01* (2013.01)

(58) Field of Classification Search
CPC ..... E21B 47/122; E21B 47/01; E21B 17/028; E21B 4/02; E21B 47/12; E21B 47/011; G01V 11/002; G01V 3/20
See application file for complete search history.

(56) References Cited

U.S. PATENT DOCUMENTS 3,789,936 A * 2/1974 McCullough ..... E21B 47/12 175/50
5,160,925 A * 11/1992 Dailey ..... E21B 47/011 175/40
5,725,061 A * 3/1998 Van Steenwyk ..... E21B 4/02 175/104

(Continued)

FOREIGN PATENT DOCUMENTS

| | | |
|---|---|---|
| EP | 1143105 A1 | 10/2001 |
| WO | 2012019182 A1 | 2/2012 |
| WO | 2014031108 A1 | 2/2014 |

OTHER PUBLICATIONS

PCT International Search Report and Written Opinion dated Sep. 7, 2016, issued in corresponding application No. PCT/US2015/034002 filed on Jun. 3, 2015, 11 pgs.

*Primary Examiner* — Kipp C Wallace
(74) *Attorney, Agent, or Firm* — Chamberlain Hrdlicka

(57) ABSTRACT

A drilling system comprising a drill string defined between an upper end and a lower end. The drill string comprises a drill pipe, a motor disposed between the drill pipe and the lower end, a drill bit disposed between the motor and the lower end, and an electronics assembly disposed within the motor or between the motor and the lower end. The electronics assembly comprises at least one sensing device.

18 Claims, 9 Drawing Sheets

(56) References Cited

U.S. PATENT DOCUMENTS

| | | | | |
|---|---|---|---|---|
| 6,188,223 | B1 * | 2/2001 | Van Steenwyk | G01V 3/20 175/50 |
| 6,952,170 | B2 * | 10/2005 | Aiello | E21B 17/003 340/854.3 |
| 7,084,782 | B2 * | 8/2006 | Davies | E21B 4/02 340/854.4 |
| 7,178,608 | B2 * | 2/2007 | Mayes | E21B 47/00 166/250.01 |
| 7,708,086 | B2 * | 5/2010 | Witte | E21B 4/003 175/107 |
| 7,832,503 | B2 * | 11/2010 | Sand | E21B 47/12 175/107 |
| 7,946,357 | B2 | 5/2011 | Trinh et al. | |
| 8,100,196 | B2 | 1/2012 | Pastusek et al. | |
| 8,191,628 | B2 * | 6/2012 | Konschuh | E21B 4/02 166/250.01 |
| 8,210,280 | B2 | 7/2012 | Trinh et al. | |
| 8,245,792 | B2 | 8/2012 | Trinh et al. | |
| 8,695,728 | B2 | 4/2014 | Trinh et al. | |
| 2007/0236222 | A1 * | 10/2007 | Gorek | G01V 3/22 324/356 |
| 2010/0051292 | A1 | 3/2010 | Trinh et al. | |
| 2011/0272195 | A1 | 11/2011 | Trinh et al. | |
| 2013/0020130 | A1 | 1/2013 | Trinh et al. | |
| 2013/0056272 | A1 | 3/2013 | Kuckes | |
| 2014/0084696 | A1 | 3/2014 | Clark | |
| 2014/0246235 | A1 | 9/2014 | Yao | |
| 2015/0053485 | A1 * | 2/2015 | Altimas | E21B 4/02 175/41 |
| 2015/0085101 | A1 | 3/2015 | Tjhang et al. | |
| 2016/0160567 | A1 * | 6/2016 | Downton | E21B 7/064 175/27 |

* cited by examiner

DRILLING TOOL WITH NEAR-BIT ELECTRONICS

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

Oil and gas wells are generally drilled by using a drill string, which is made up of drill pipe and a bottom hole assembly (BHA). The bottom hole assembly traditionally includes a drill bit which breaks up rock formations to create a well, a motor which provides rotational drive to the drill bit, and one or more logging while drilling (LWD) and measurement while drilling (MWD) tools. For example, the BHA can include a mud motor, a rotary steerable system (RSS), or both. The LWD/MWD tools include a variety of sensors which collect data during the drilling process regarding a variety well characteristics such as rock porosity, permeability, pressure, temperature, magnetic field, gravity, acceleration, magnetic resonance characteristics or fluid flow rate, pressure, mobility, or viscosity characteristics of a fluid within the borehole, as well as various drilling characteristics or parameters including the direction, inclination, azimuth, trajectory, and the like.

BRIEF DESCRIPTION OF THE DRAWINGS

Illustrative embodiments of the present disclosure are described in detail below with reference to the attached drawing figures, which are incorporated by reference herein and wherein.

Figure 1:
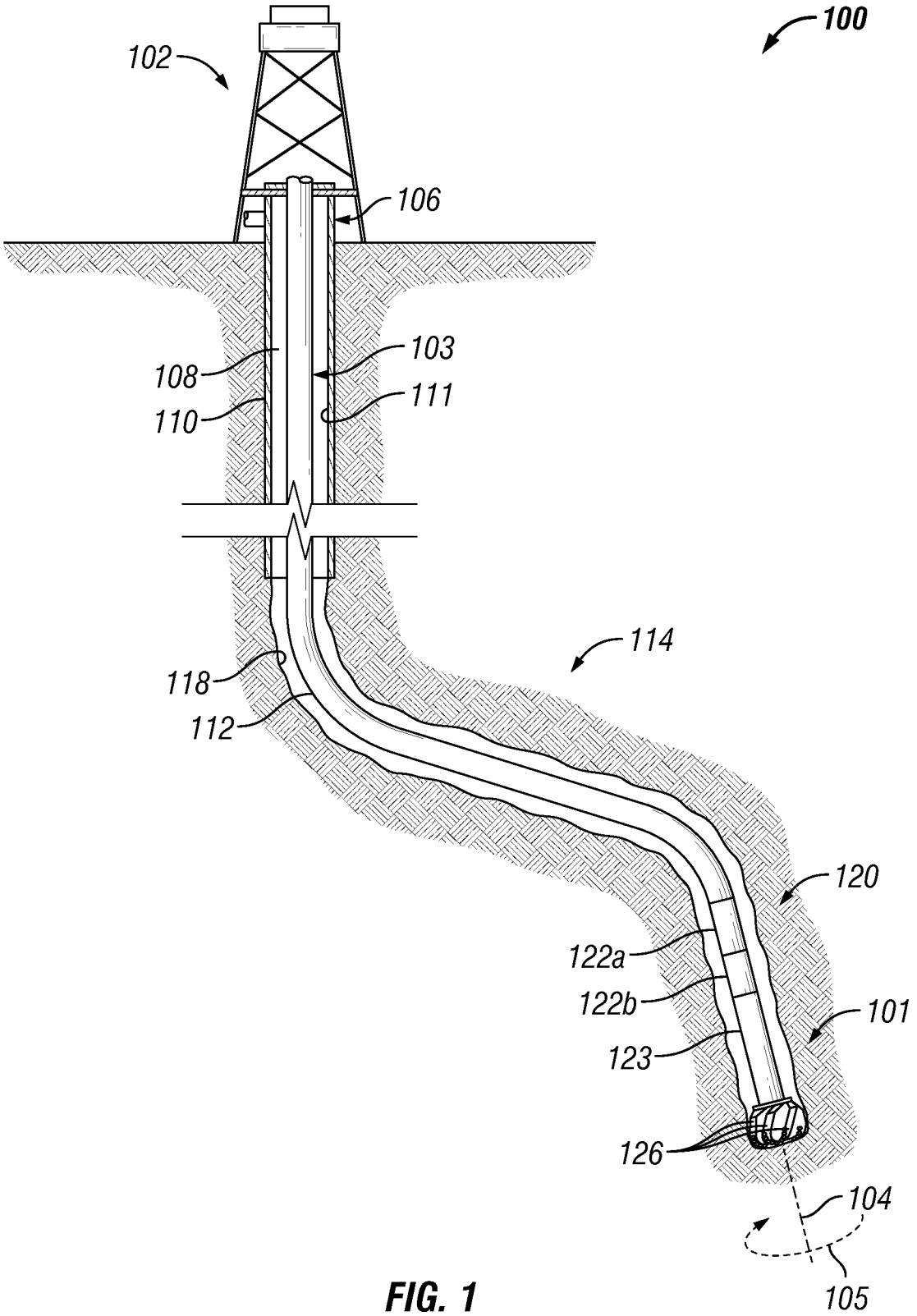
FIG. 1 illustrates a well being drilled drilling system, in accordance with example embodiments of the present disclosure.
Figure 2A:
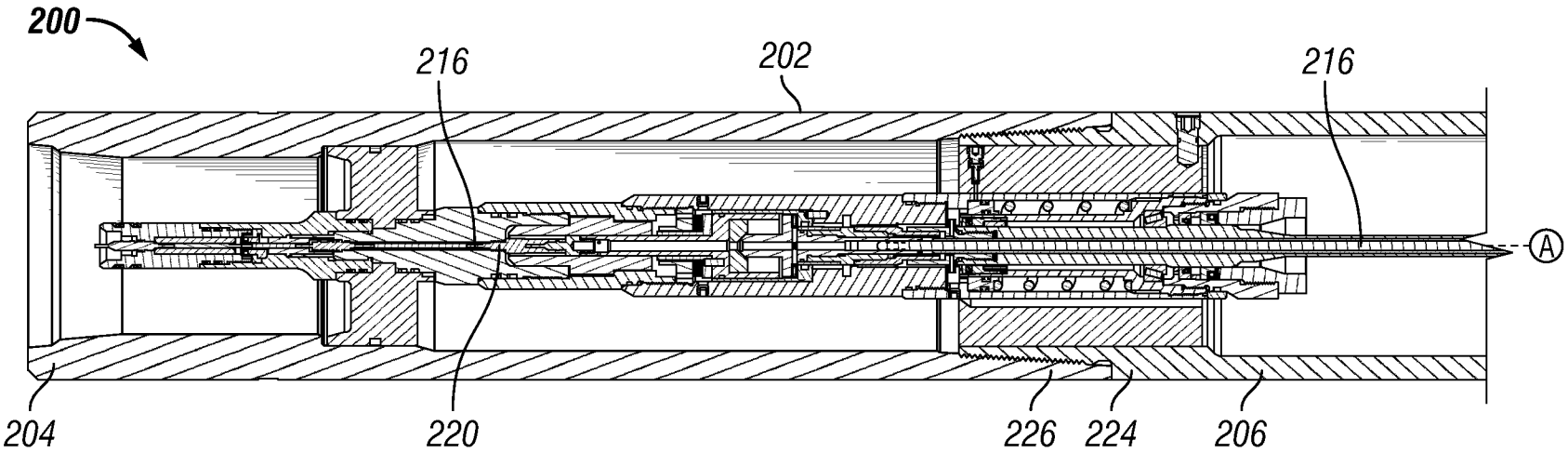
FIG. 2A-2E illustrate, in continuous longitudinal sequence, a drilling tool, in which FIG. 2B continues from FIG. 2A at point A, FIG. 2C continues from FIG. 2B at point B, FIG. 2D continues from FIG. 2C at point C, and FIG. 2E continues from FIG. 2D at point D, in accordance with example embodiments of the present disclosure.
Figure 2B:
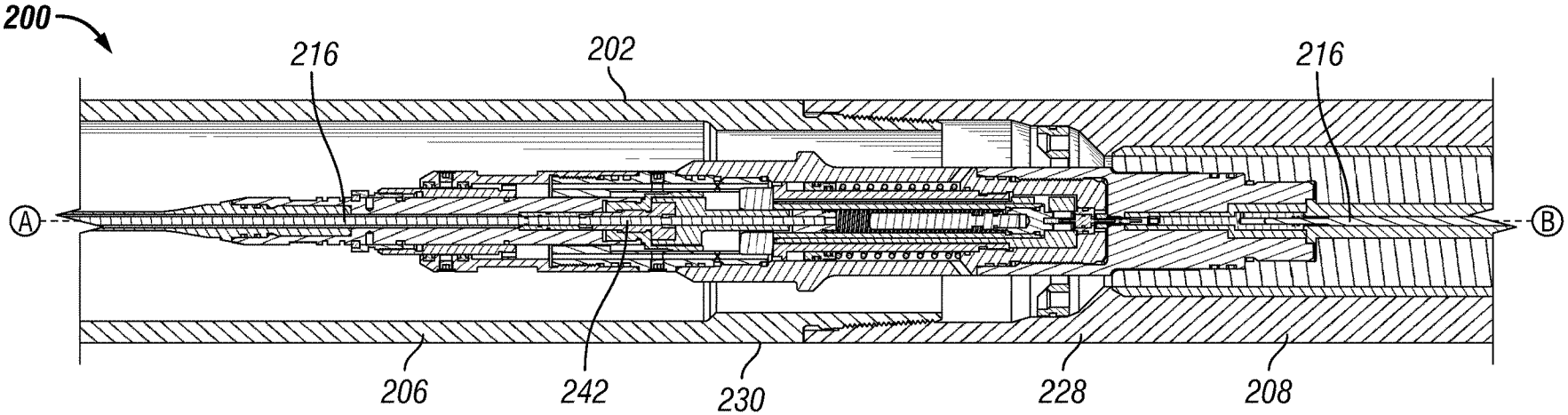
Figure 2C:
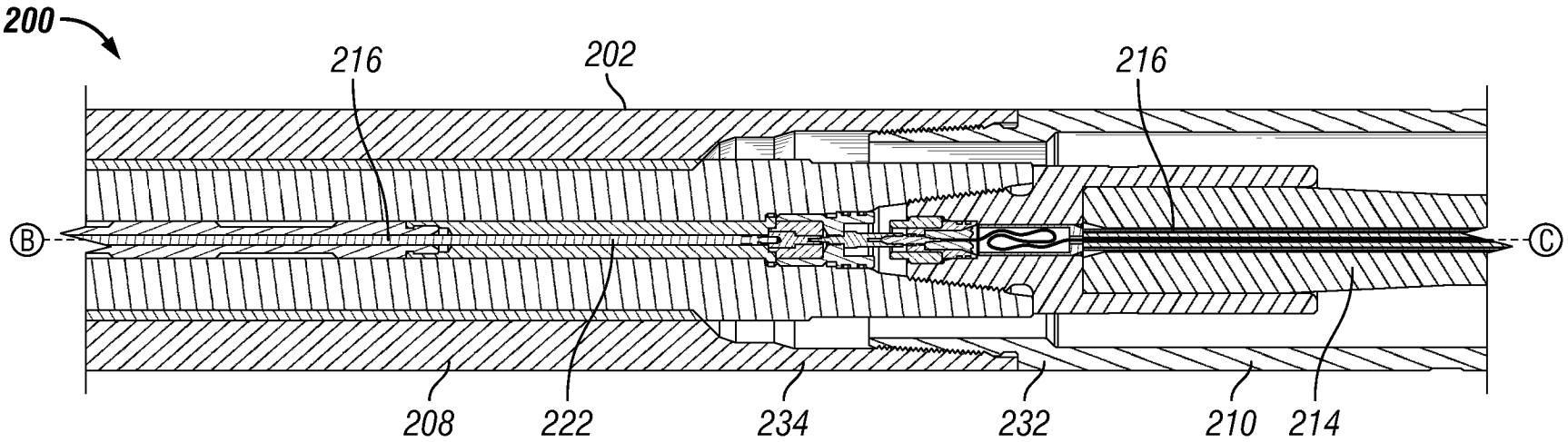
Figure 2D:
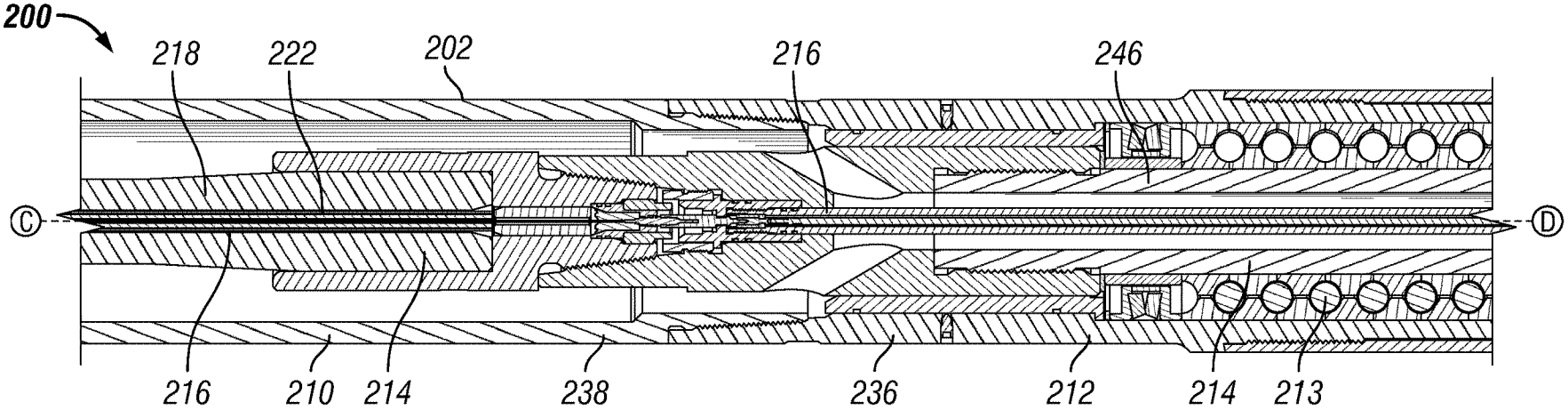
Figure 2E:
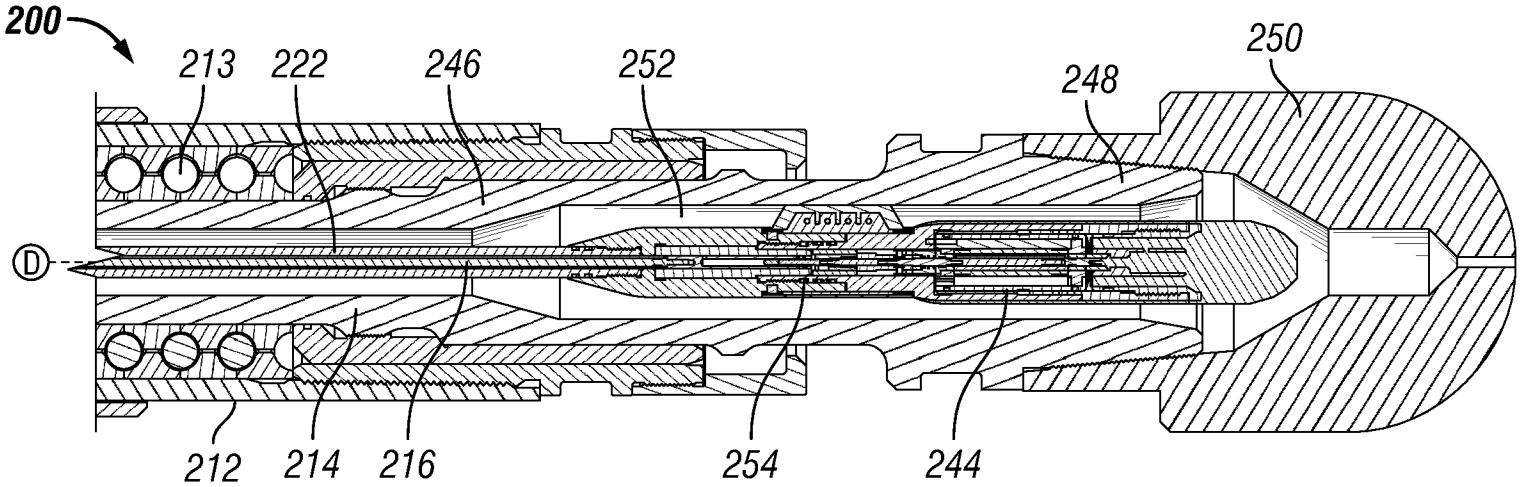

The illustrated figures are only exemplary and are not intended to assert or imply any limitation with regard to the environment, architecture, design, or process in which different embodiments may be implemented.

DETAILED DESCRIPTION OF ILLUSTRATIVE EMBODIMENTS

The present disclosure includes various embodiments of a drilling tool that enable electronic sensors, such as those used in logging while drilling (LWD) and measurement while drilling (MWD) tools, to be located nearer a distal end of the drilling tool. Typically, the drill bit is the lowest component of the drill string; the motor, RSS, or both, is above the drill bit; and the LWD/MWD tools are above the motor. As such, the sensors are a distance away from the drill bit. Thus, conditions reported by the sensors, such as direction, inclination, and azimuth, outputs, may not be truly representative of conditions currently at the bit. With sensors located closer to the distal end of the drilling tool, conditions are sensed from a position closer to the bit and provide more accurate and timely measurement data. The improved data allows the drilling system to be controlled more effectively, ultimately leading to more effective drilling operations. For example, the near-bit sensors allows for increased timeliness in distinguishing rock formations as the drill bit moves from one formation to another, as well as improved estimation of the formation properties and location of the bit.

In some embodiments of the drilling tool, the electronic sensors are disposed near, adjacent, within, or partially within the drill bit of the drilling tool. The drilling tool disclosed herein is able to provide MWD and LWD function, potentially eliminating the need for separate MWD/LWD tools in a drilling system.

FIG. 1A is an elevation view of a representative wellsite 100 wherein a wellbore 114 may be drilled by a drilling tool. Various types of drilling equipment, such as a rotary table, drilling fluid pumps and drilling fluid tanks (not expressly shown) may be located at the well site 100. For example, the well site 100 may include a land drilling rig 102, although the downhole drilling tools of the present disclosure may be used at other types of well sites, such as on offshore platforms, drill ships, semi-submersibles and drilling barges.

A drill string 103 and a bottom hole assembly (BHA) 120, including a drill bit 101 at the lower end, may be used to form a wide variety of wellbores using conventional and/or directional drilling techniques. The term "directional drilling" may be used to describe drilling a wellbore or portions of a wellbore with the ability to controllably change directions while drilling. Directional drilling may be used to access multiple target reservoirs within a single wellbore 114 or reach a reservoir that may be inaccessible via a vertical wellbore.

The BHA 120 may also include a rotary steerable drilling system 123 to perform directional drilling. The rotary steerable drilling system 123 may use a point-the-bit method to cause the direction of the drill bit 101 to vary relative to the housing of the rotary steerable drilling system 123 by bending a shaft running through the rotary steerable drilling system 123. In some embodiments, the rotary steerable drilling system 123 may use a push-the-bit method which utilizes pads on the outside of the tool which press against the well bore, causing the bit to press on the opposite side causing a direction change.

The BHA 120 may include a wide variety of other components configured to form the wellbore 114. For example, the BHA may include components 122*a* and 122*b*. Such components 122*a* and 122*b* may include, but are not limited to, drill collars, downhole drilling motors, reamers, hole enlargers, and/or stabilizers. The number and types of components 122 included in the BHA 120 may depend on anticipated downhole drilling conditions and the type of wellbore that is to be formed. Further, the BHA 120 may also include a rotary drive (not expressly shown) connected to components 122*a* and 122*b* and which rotates at least part of the drill string 103 together with components 122*a* and 122*b*. The BHA 120 further includes a mud motor 123, which is optionally included in certain directional drilling systems to temporarily drive rotation of the drill bit 101 during periods when the drill string 103 is temporarily halted. In some embodiments, the mud motor 123 is a progressive cavity positive displacement pump (PCPD) which includes a rotor and a stator such that fluid traversing the motor between the rotor and the stator causes the motor 123 to turn, thereby turning the bit 101. In some embodiments, the fluid is drilling fluid, or "mud", pumped through the motor 123 from a surface source. The drilling tool may further include a telemetry system for communication between surface facilities at the well site 100 and downhole equipment. It should be appreciated that any appropriate form of telemetry may be used, including wired and mud pulse telemetry.

The wellbore 114 may be reinforced in whole or in part by a casing string 110 that may extend from the surface of the well site 100 to a selected downhole location. Portions of the wellbore 114 that do not include the casing string 110 may be described as "open hole." Various types of drilling fluid may be pumped from the surface of the well site 100 downhole through the drill string 103 to the motor 123 and drill bit 101. The drilling fluids may be directed to flow from the drill string 103 to respective nozzles passing through the drill bit 101. The drilling fluid may be circulated up-hole to the well surface 106 through an annulus 108. In open hole embodiments, the annulus 108 may be defined in part by an outside diameter 112 of the drill string 103 and an inside diameter 118 of the wellbore 114. In embodiments using a casing string 110, the annulus 108 may be defined by an outside diameter 112 of the drill string 103 and an inside diameter 111 of the casing string 110.

FIGS. 2A-2E are cross sections, in sequence, a drilling motor 200 and drill bit 250, such as the motor 123 of FIG. 1, in accordance with example embodiments of the present disclosure. Specifically, FIG. 2B continues from FIG. 2A at point A, FIG. 2C continues from FIG. 2B at point B, FIG. 2D continues from FIG. 2C at point C, and FIG. 2E continues from FIG. 2D at point D.

Referring to FIGS. 2A-2E, in some embodiments, the drilling motor 200 includes a combination of a housing 202, an upper sub 204, an upper flex sub 206, a power unit 208, a transmission unit 210, and a bearing sub 212, each of which may be removably threaded, or otherwise coupled, together longitudinally. In some embodiments, a proximal end 224 of the upper flex sub 206 is coupled to a distal end 226 of the upper sub 204, a proximal end 228 of the power unit 208 is coupled to a distal end 230 of the upper flex sub 206, a proximal end 232 of the transmission unit 210 is coupled to a distal end 234 of the power unit 208, and a proximal end 236 of the bearing sub 212 is coupled to a distal end 238 of the transmission unit 210.

The power unit 208 of the drilling motor 200 generates the power provided by the drilling motor 200 to rotate a drill bit 250. In some embodiments, the power unit 208 is comprised of a progressing cavity positive displacement pump, which rotates as drilling fluid traverses therethrough. The drilling motor 200 may include a single component or a plurality of components other than those described.

The drilling motor 200 further includes a shaft 214 disposed within the housing 202 and extending from the power unit 208 through the transmission unit 210 and the bearing sub 212. The shaft 214 is rotatably supported and is capable of rotary movement within the housing 202 by operation of the drilling motor 200. However, the shaft 214 may also undergo or is capable of both longitudinal movement and transverse movement. Longitudinal movement is movement of the shaft 214 relative to the housing 202 in an axial direction along or parallel with a longitudinal axis of the shaft 214. Transverse movement is a movement of the shaft 214 relative to the housing 202 in a radial direction perpendicular with or transverse to the longitudinal axis of the shaft 214.

The bearing sub 212 includes a bearing assembly 213 surrounding a drive shaft 246 and including bearings so as to be configured to facilitate rotation of and stabilize the drive shaft 246. The bearing assembly 213 may include one type or a combination of types of bearings, including radial and thrust bearings.

In some embodiments, the shaft 214 includes a transmission shaft 218 and a drive shaft 246. The transmission shaft 218 is disposed within the transmission unit 210 and coupled to the power unit 208, and the drive shaft 246 is disposed within the bearing sub 212 and coupled to the transmission shaft 218 opposite the power unit 208. In some embodiments, the drive shaft 246 comprises a distal end 248 that couples to the bit 250. In some embodiments, the distal end 248 of the drive shaft 246 is also the distal end of the entire shaft 214. In some embodiments, the drive shaft 246 includes an internal orifice 252. The internal orifice 252 can be located anywhere within or along the length of the drive shaft 246, or traverse the entire length of the drive shaft 246. The internal orifice 252 may be located centrally within the drive shaft 246.

The drill bit 250 may be comprised of any type or configuration of drill bit suitable for performing the desired drilling operation and which is compatible with the drilling motor 200. For example, the drill bit 250 may be comprised of a polycrystalline diamond cutter ("PDC") bit, a roller cone bit, a long or extended gauge bit, a bit having straight or spiral blades or any other bit configuration compatible with the drilling operation to be performed. Additionally, the drill bit 250 may be comprised of a single integral member or element or it may be comprised of a plurality of members or elements connected, mounted or fastened together in any manner to provide the desired drill bit 250. In some embodiments, the drill bit 250 is an extended gauge bit.

Further, the drilling motor 200 includes a conducting path 216 which extends within the housing 202 through one or more of the upper sub 204, the upper flex sub 206, the power unit 208, the transmission unit 210, and the bearing sub 212. In some embodiments, the conducting path 216 longitudinally traverses the shaft 214. In some embodiments, the conducting path 216 is comprised of a first conductor 220, a second conductor 222, and an assimilating connector 242. In some embodiments, the first conductor 220 is associated with the housing 202 or upper sub 204 and the second conductor 220 is associated with the shaft 214, and the assimilating connector 242 conductively connects the first conductor 220 and the second conductor 222, wherein the conductors 220, 222 are capable of a movement relative to each other.

More particularly, the assimilating connector 242 is interposed between the first and second conductors 220, 222 for conductively connecting the conductors 220, 222 and for assimilating the relative movement of the conductors 220, 222. The relative movement of the conductors 220, 222 may be comprised of a rotary movement, a longitudinal movement, a transverse movement, or combinations thereof Thus, the second conductor 222 rotates with the shaft 214 relative to the housing 202 and first conductor 220. In some embodiments, the second conductor 222 is disposed within the shaft 214 and a portion of the second conductor 222 is disposed within the internal orifice 250 of the drive shaft 248.

The conducting path 216, including the assimilating connector 242, is provided to facilitate the transmission of power, communication signals, or both, within or through the downhole drilling motor 200. The conducting path 216 may be used to communicate power or communication signals along or through any length or portion of the drilling motor 200 and may be used to communicate power or communication signals within the drilling motor 200.

The conducting path 216 may be used to communicate power and/or communication signals in both directions within the drilling motor 200 so that the power and/or communication signals can be communicated either toward the surface or away from the surface of a borehole in which the drilling motor 200 is contained. As such the conducting path 216 may be used as or part of a power and/or communication system for communication with surface facilities. In some embodiments, a distal end 254 of the conducting path 216 includes an interface for coupled the conducting path 216 to one or more communicative devices. In some embodiments, the interface includes a stab-in connector.

The conducting path 216 can be an electrical conducting path. The electrical signal can be any electrical signal, including unipolar alternating current (AC) signals, bipolar AC signals and varying direct current (DC) signals. The electrical signal may be a wave, pulse or other form. For instance, the electrical signal may be a modulated signal that embodies the information to be communicated. In this instance, the electrical signal may be modulated in any manner, such as for example by using various techniques of amplitude modulation, frequency modulation and phase modulation. Pulse modulation, tone modulation, and digital modulation techniques may also be used to modulate the electrical signal.

The drilling motor 200 also includes an electronics assembly 244. In some embodiments, the electronics assembly 244 is coupled to the distal end 242 of the conducting path 216. In some embodiments, the electronics assembly 244 is disposed within the internal orifice 252 of the drive shaft 246. In some embodiments, the electronics assembly 244 is electrically and/or mechanically coupled to the conducting path 216, putting the electronics assembly 244 in communication with the conducting path. In certain such embodiments, the electronics assembly 244 is coupled to the distal end 254 of the conducting path 216. Thus, the electronics assembly 244 may be communicative with surface facilities at the well site 100 or otherwise.

In some embodiments, the electronics assembly 244 is disposed partially within the drive shaft 246 and extends partially past the distal end 248 of the drive shaft 246 and into the bit 250. In some embodiments, the electronics assembly 244 is disposed completely within the shaft 214. In some embodiments, the electronics assembly 244 is disposed below the power unit 208, in which "below" refers to a position closer to the bit 250 rather than away from the bit. In some embodiments, the electronics assembly 244 extends partially or completely into the bit 250. In some embodiments, the electronics assembly 244 is disposed above the power unit 208, in which "above" refers to a location further away from the bit 250. In some embodiments, the electronics assembly 244 is disposed within the housing 202 of the drilling motor 200.

In some embodiments, the electronics assembly 244 is easily removed and interchangeable such that one electronics assembly 214 can be switched out for another without substantially taking apart or changing the entire tool. In some embodiments, only the bit 250 needs to be removed in order to switch out or replace the electronics assembly 244. This particularly facilitates operations during which it is desirable to change the style of sensors used.

Figure 3:
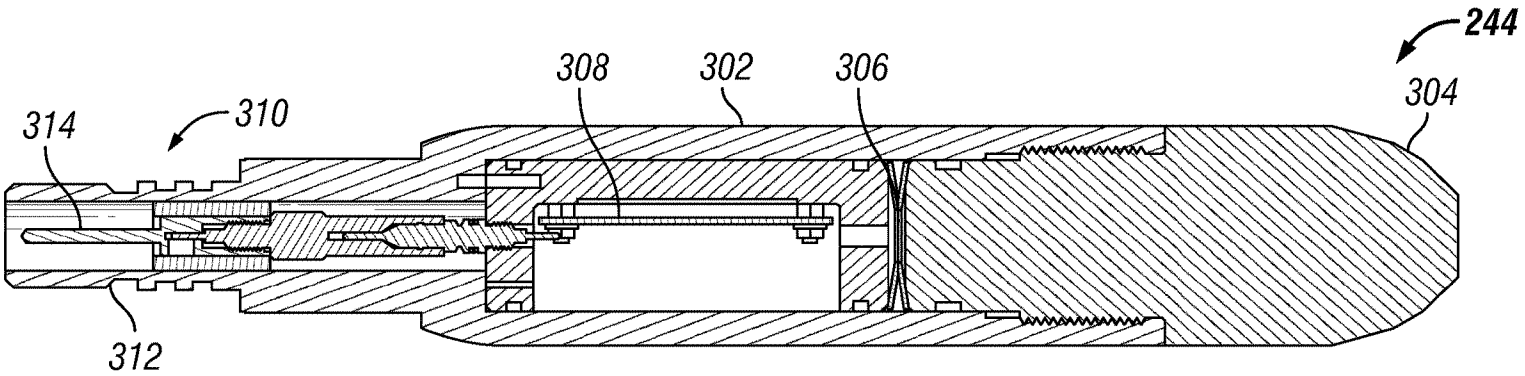
FIG. 3 illustrates a cross-sectional view of an electronics assembly, in accordance with example embodiments of the present disclosure.
Figure 4:
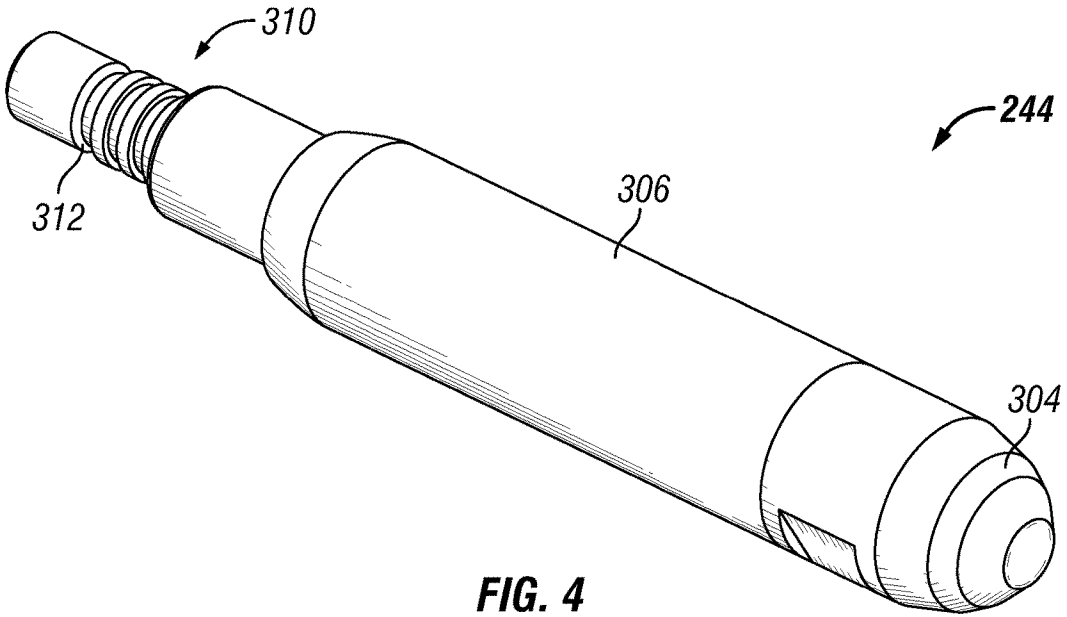
FIG. 4 illustrates a perspective view of the electronics assembly of FIG. 3, in accordance with example embodiments of the present disclosure.

FIG. 3 illustrates a cross-sectional view of the electronics assembly 244 and FIG. 4 illustrates a perspective view of the electronics assembly 244, in accordance with example embodiments of the present disclosure. In some embodiments, the electronics assembly 244 includes a housing body 302 and a sensor package 304. In some embodiments, the sensor package 304 has a bullnose shape and is partially positioned in the housing body 302. The sensor package 304 is coupled to a portion of the housing body 302 via a compression spring to mitigate vibrations. The sensor package 304 includes one or more sensors for sounding one or more down-hole or equipment conditions.

For example, the one or more sensors may provide information concerning one or more of the following: characteristics of the borehole or the surrounding formation including natural gamma ray, resistivity, density, compressional wave velocity, fast shear wave velocity, slow shear wave velocity, dip, radioactivity, porosity, permeability, pressure, temperature, vibration, acoustic, seismic, magnetic field, gravity, acceleration (angular or linear), magnetic resonance characteristics or fluid flow rate, pressure, mobility, or viscosity characteristics of a fluid within the borehole or the surrounding formation; drilling characteristics or parameters including the direction, inclination, azimuth, trajectory or diameter of the borehole or the presence of other proximate boreholes; and the condition of the drill bit 101 or other components of the drilling motor 200 including weight-on-bit, drill bit temperature, torque on bit or the differential pressure across the bit.

In some embodiments, the electronics assembly 244 further includes an electronics board 308 disposed within the housing 302. The electronics board 308 is electrically coupled to the one or more sensors in the sensor package 304 and may perform some signal processing on the outputs of the one or more sensors, or otherwise prepare the outputs for transmission up-hole to other tools (e.g., MLD/LWD tools) on the drill string or to surface facilities. The electronics assembly 244 also includes a coupling end 310 that includes an electrical connector 314, which is electrically coupled to the electronics board 308, and a mechanical connector 312. The electrical connector 314 may be a stab-in connector or other conductive interface. The mechanical connector 312 may be a threaded connector, push-in connector, or other coupling means. The coupled end 310 is configured to couple to the conducting path 216 of the motor 200. Thus, outputs of the one or more sensors of the electronics assembly 244 are delivered to other tools or surface facilities via the conductive path 216.

Figure 5:
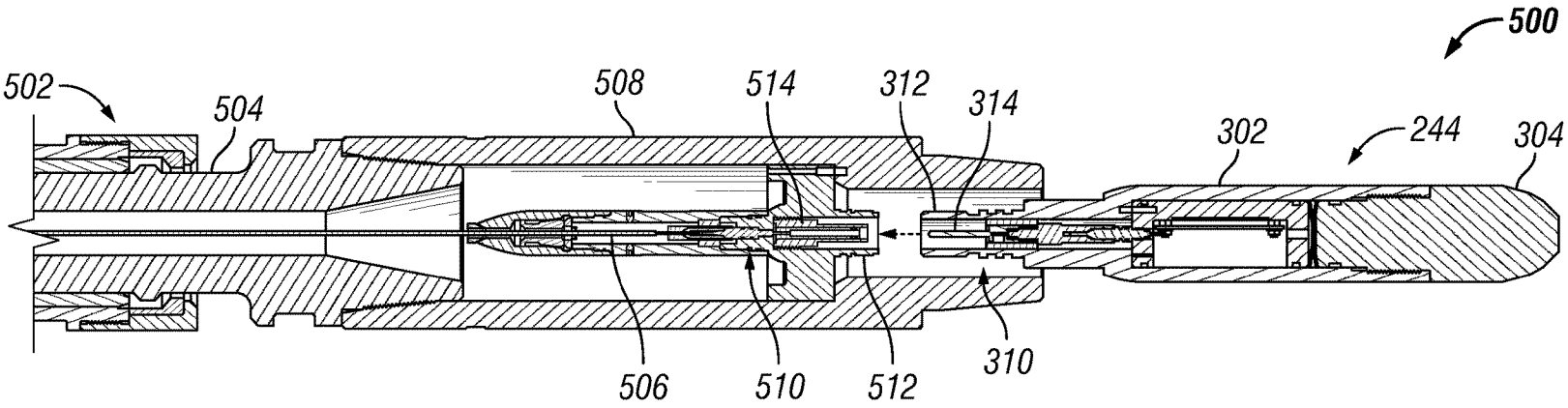
FIG. 5 illustrates a distal end of a drilling tool, in accordance with example embodiments of the present disclosure.

FIG. 5 illustrates a distal assembly 500 of a drilling motor 502, in accordance with example embodiments of the present disclosure. The distal assembly 500 includes a distal portion of a drilling motor 502, through which a shaft 504 extends. The distal assembly 500 further includes a mounting sub 508 coupled to the shaft 504 opposite the drilling motor 502. A wireline or conductive path 506 extends from the drilling motor 502 into the mounting sub 508. In some embodiments, the wireline or conductive path 506 includes multiple segments electrically coupled together. In some embodiments, the mounting sub 508 includes a coupling interface 510 disposed therein. In some embodiments, the coupling interface 510 includes a mechanical connector 512 and an electrical connector 514. The mounting sub 508 is configured to receive and/or retain at least a portion of the electronics assembly 244. Specifically, the mechanical connector 312 of the electronics assembly 244 is configured to couple with the mechanical connector 512 of the coupling interface 510 and the electrical connector 314 of the electronics assembly 244 is configured to couple to the electrical connector 514 of the coupling interface 510. The electrical connector 514 of the coupling interface 510 is also electrically coupled to the wireline or conductive path 506. Thus, the electronics assembly is electrically coupled to the wireline or conductive path 506 via the coupling interface 510. In some embodiments, the electronics assembly 244 is disposed below the drilling motor 502 and/or below the shaft 504.

Figure 6:
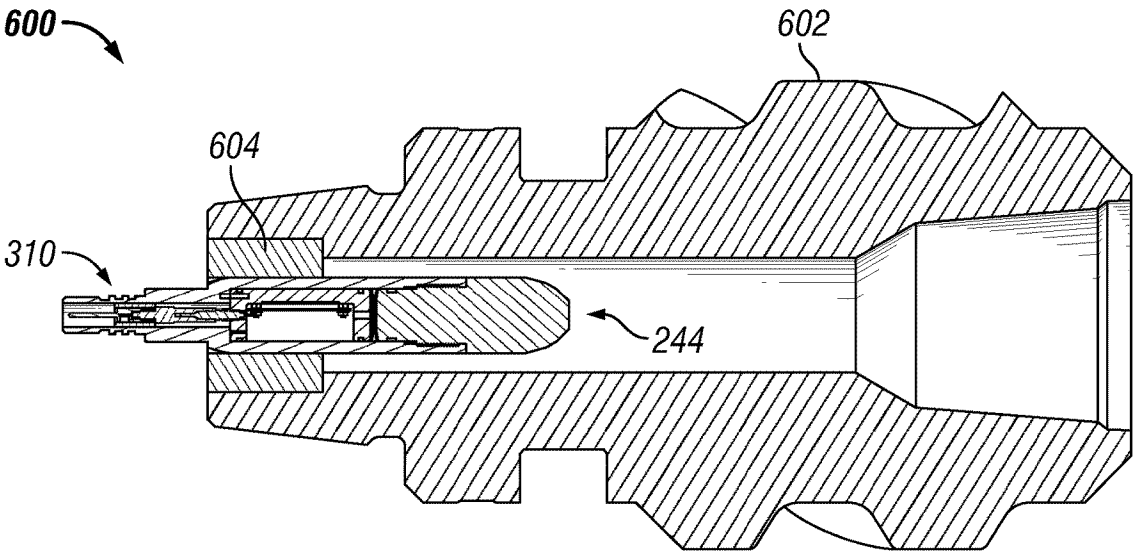
FIG. 6 illustrates the electronics assembly of FIG. 3 keyed with a drill bit, in accordance with example embodiments of the present disclosure.

FIG. 6 illustrates the electronics assembly of FIG. 3 installed with a drill bit 602, in accordance with example embodiments of the present disclosure. In some embodiments, a fitting 604 is disposed substantially between the drill bit 602 and the electronics assembly 244, as a means to fit the electronics assembly 244 to the bit 602. In some embodiments, the fitting 604 may have an outer shape configured to fit into complimentary shape of the bit 602. In certain such embodiments, the fitting 604 may also have an inner shape complimentary with the shape of a region of the electronics assembly 244 such that the electronics assembly 244 can be disposed within the fitting 604 in a certain configuration. In some embodiments, the fitting 694 may be integral to or a part of the electronics assembly. Conversely, in some embodiments, the fitting 604 may be integral to or a part of the bit 602.

Figure 7:
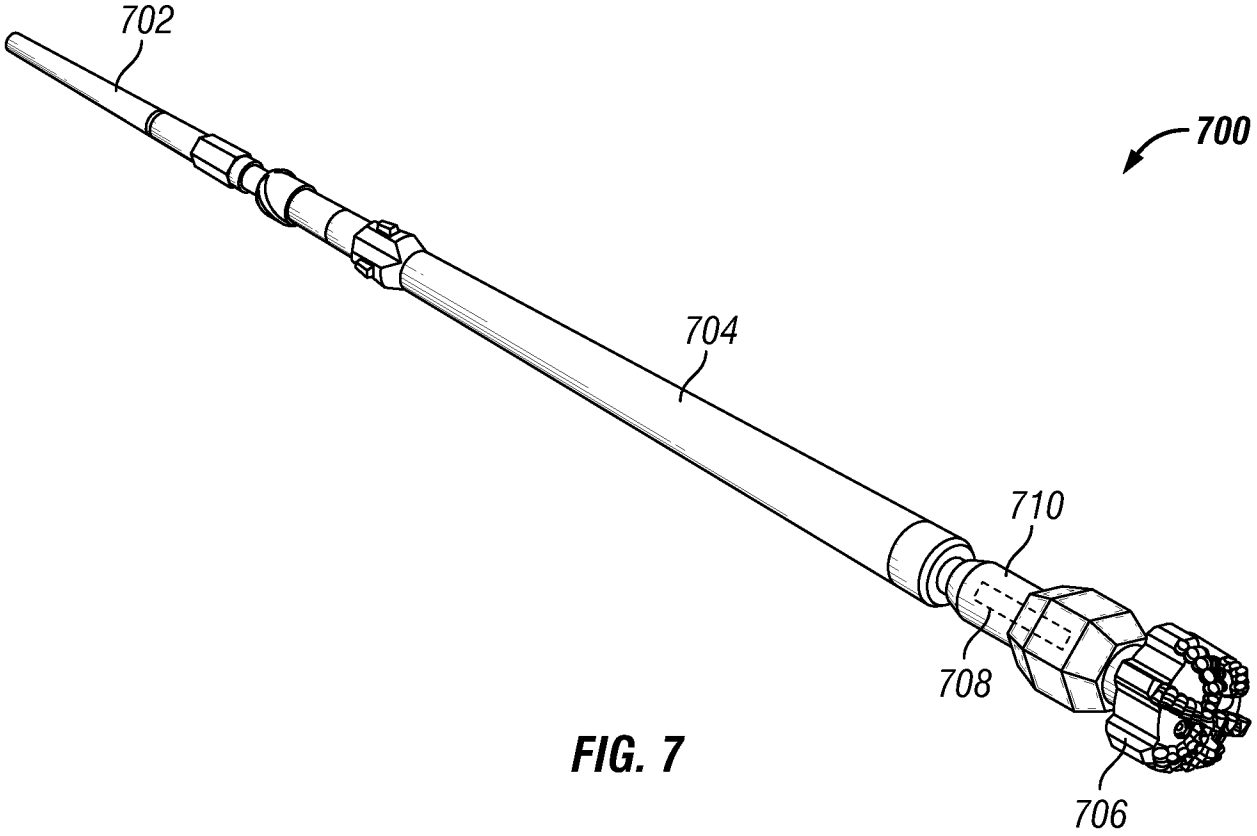
FIG. 7 illustrates a rotary steerable drilling tool, in accordance with example embodiments of the present disclosure.

FIG. 7 illustrates a rotary steerable drilling system 700, in accordance with example embodiments of the present disclosure. In some embodiments, the drilling tool 700 includes a motor 702, a rotary steerable system 704 coupled to the motor, and a bit 706 coupled to the rotary steerable system 704. In some embodiments, the bit 706 is coupled to a shaft 710 of the rotary steerable system 704. In some embodiments, the drilling system 700 includes an electronics assembly 708 disposed therein. The electronics assembly 708 includes one or more sensing devices. Specifically, in some embodiments, the electronics assembly 708 is disposed at least partially within the shaft 710. In some embodiments, the electronics assembly 708 extends partially into the bit 706. In some embodiments, the electronics assembly 708 is disposed within the rotary steerable system 704. In some embodiments, the electronics assembly 708 is coupled to a conducting path extending through the rotary steerable system 704 and the motor 702. In some embodiments, the motor 702 is omitted and the rotary steerable drilling system 700 includes the rotary steerable system 704 and the bit 706.

In addition to the embodiments described above, many examples of specific combinations are within the scope of the disclosure, some of which are detailed below:

Example 1: A drilling system, comprising:
- a drilling motor comprising:
  - a housing;
  - a power unit disposed within the housing; and
  - a drive shaft comprising a proximal end and a distal end, the proximal end coupled to the power unit;
- a drill bit coupled to the distal end of the drive shaft; and
- an electronics assembly disposed within the drilling motor, coupled to the drive shaft, or both, the electronics assembly comprising a sensing device.

Example 2: The drilling system of Example 1, wherein the electronics assembly is disposed within the drive shaft.

Example 3: The drilling system of Example 1, wherein the electronics assembly is coupled to the distal end of the drive shaft.

Example 4: The drilling system of Example 1, wherein the wherein the electronics assembly is located at least partially into the drill bit.

Example 5: The drilling system of Example 2, wherein the electronics assembly comprises one or more stabilizers extending from the electronics assembly and configured to stabilize the electronics assembly within the drive shaft Example 6: The drilling system of Example 1, wherein the electronics assembly further comprises:
- an electronics housing, the sensing device disposed within the electronics housing; and
- a connector formed at one end of the electronics housing, the connector configured to mechanically and electrically couple the electronics assembly to a conductive path within the drilling motor.

Example 7: The drilling system of Example 6, wherein the conductive path provides power transmission and data communication.

Example 8: The drilling system of Example 6, wherein the connector comprises a threaded connector.

Example 9: The drilling tool of Example 6, wherein the connector includes a stab-in electronics connector.

Example 10: The drilling system of Example 1, further comprising:
- a measurement while drilling or logging while drilling tool disposed up-hole of the drilling motor, wherein the electronics assembly is communicatively coupled to the measurement while drilling or logging while drilling tool.

Example 11: The drilling system of Example 1, wherein the sensing device is configured to sense at least one a drilling condition, drilling tool condition, formation data, and location data.

Example 12: A drilling system, comprising:
- a drilling motor comprising:
  - a housing;
  - a power unit disposed within the housing; and
  - a drive shaft comprising a proximal end and a distal end, the proximal end coupled to the power unit;
- a conductive path traversing at least a portion the drilling motor; and
- an electronics assembly coupled to the conductive path, the electronics assembly comprising a sensing device.

Example 13: The drilling system of Example 12, wherein the electronics assembly is located at least partially within the drilling motor.

Example 14: The drilling system of Example 12, wherein the electronics assembly is located at least partially within the drive shaft.

Example 15: The drilling system of Example 12, further comprising:
- a mounting sub coupled to the distal end of the drive shaft, wherein the electronics assembly is coupled to the mounting sub.

Example 16: A drilling system, comprising:
- a drill string defined between an upper end and a lower end, the drill string comprising:
  - a drill pipe;
  - a bottom hole assembly disposed between the drill pipe and the lower end;
  - a drill bit disposed between the bottom hole assembly and the lower end; and
  - an electronics assembly disposed within the bottom hole assembly or between the bottom hole assembly and the lower end, wherein the electronics assembly comprises a sensing device.

Example 17: The drilling system of Example 16, further comprising a drive shaft extending from the bottom hole assembly to the drill bit, the electronics assembly disposed at least partially within the bottom hole assembly, the drive shaft, or both.

Example 18: The drilling system of Example 16, further comprising:

a rotary steerable system (RSS) disposed within the bottom hole assembly or between the bottom hole assembly and the bit.

Example 19: The drilling system of Example 18, further comprising a drive shaft extending from the RSS to the drill bit, the electronics assembly disposed at least partially within the RSS, drive shaft, or both.

Example 20: The drilling system of Example 16, further comprising a conductive path traversing at least a portion of the bottom hole assembly, the electronics assembly electrically coupled to the conductive path.

This discussion is directed to various embodiments of the present disclosure. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to intimate that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but are the same structure or function.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

We claim:

1. A drilling system, comprising:

a drilling motor comprising: a housing;

a power unit disposed within the housing; and a drive shaft comprising a proximal end and a distal end, the proximal end coupled to the power unit; a drill bit coupled to the distal end of the drive shaft; and an electronics assembly disposed within an internal orifice of the drilling motor extending at least partially past the distal end of the drive shaft into the drill bit without being directly connected to or supported by the drill bit, wherein the electronics assembly comprises a sensing device at least partially disposed within a housing.

2. The drilling system of claim 1, wherein the electronics assembly is disposed within the drive shaft.

3. The drilling system of claim 1, wherein the electronics assembly is coupled to the distal end of the drive shaft.

4. The drilling system of claim 2, wherein the electronics assembly comprises one or more stabilizers extending from the electronics assembly and configured to stabilize the electronics assembly within the drive shaft.

5. The drilling system of claim 1, wherein the electronics assembly further comprises:

a connector formed at one end of the electronics housing, the connector configured to mechanically and electrically couple the electronics assembly to a conductive path within the drilling motor.

6. The drilling system of claim 5, wherein the conductive path provides power transmission and data communication.

7. The drilling system of claim 5, wherein the connector comprises a threaded connector.

8. The drilling tool of claim 5, wherein the connector includes a stab-in electronics connector.

9. The drilling system of claim 1, further comprising a measurement while drilling or logging while drilling tool disposed up-hole of the drilling motor, wherein the electronics assembly is communicatively coupled to the measurement while drilling or logging while drilling tool.

10. The drilling system of claim 1, wherein the sensing device is configured to sense at least one of a drilling condition, drilling tool condition, formation data, and location data.

11. A drilling system, comprising:

a drilling motor comprising:

a housing;

a power unit disposed within the housing; and a drive shaft comprising a proximal end and a distal end, the proximal end coupled to the power unit;

a conductive path traversing at least a portion the drilling motor; and an electronics assembly disposed within an internal orifice of the drilling motor extending at least partially past the distal end of the drive shaft into the drill bit without being directly connected to or supported by the drill bit, the electronics assembly comprising a sensing device at least partially disposed within a housing.

12. The drilling system of claim 11, wherein the electronics assembly is located at least partially within the drive shaft.

13. The drilling system of claim 11, further comprising a mounting sub coupled to the distal end of the drive shaft, wherein the electronics assembly is coupled to the mounting sub.

14. A drilling system, comprising:

a drill string defined between an upper end and a lower end, the drill string comprising: a drill pipe;

a bottom hole assembly disposed between the drill pipe and the lower end;

a drill bit disposed between the bottom hole assembly and the lower end; and an electronics assembly disposed within an internal orifice of the bottom hole assembly and extending at least partially past a distal end of the drive drill pipe into the drill bit without being directly connected to or supported by the drill bit, wherein the electronics assembly comprises a sensing device at least partially disposed within a housing.

15. The drilling system of claim 14, further comprising a drive shaft extending from the bottom hole assembly to the drill bit, the electronics assembly disposed at least partially within the bottom hole assembly, the drive shaft, or both.

16. The drilling system of claim 14, further comprising a rotary steerable system (RSS) disposed within the bottom hole assembly or between the bottom hole assembly and the bit.

17. The drilling system of claim 16, further comprising a drive shaft extending from the RSS to the drill bit, the electronics assembly disposed at least partially within the RSS, drive shaft, or both.

18. The drilling system of claim 14, further comprising a conductive path traversing at least a portion of the bottom hole assembly, the electronics assembly electrically coupled to the conductive path.

* * * * *